US007055440B2

(12) United States Patent
Sisk

(10) Patent No.: US 7,055,440 B2
(45) Date of Patent: Jun. 6, 2006

(54) REMOTELY OPERATED MANHOLE COVER FOR A TANKER

(75) Inventor: David E. Sisk, Mineral Point, MO (US)

(73) Assignee: Delaware Capital Formation, Riverside, MO (US)

( * ) Notice: Subject to any disclaimer, the term of this patent is extended or adjusted under 35 U.S.C. 154(b) by 417 days.

(21) Appl. No.: 10/040,593

(22) Filed: Jan. 7, 2002

(65) Prior Publication Data

US 2002/0100225 A1 Aug. 1, 2002

Related U.S. Application Data

(60) Provisional application No. 60/260,406, filed on Jan. 9, 2001.

(51) Int. Cl.
*B61D 3/00* (2006.01)
*B61D 39/00* (2006.01)

(52) U.S. Cl. ..... 105/286; 105/377.06

(58) Field of Classification Search ..... 105/238.1, 105/241.2, 240, 280, 286, 358, 377.01, 377.05, 105/377.06
See application file for complete search history.

(56) References Cited

U.S. PATENT DOCUMENTS 4,854,076 A * 8/1989 Sieben et al. ..... 49/280
5,359,942 A * 11/1994 Ward ..... 105/240
5,366,317 A 11/1994 Solimar
5,937,581 A * 8/1999 Matye et al. ..... 49/279
6,053,348 A * 4/2000 Morch ..... 220/263
RE36,685 E * 5/2000 Bounds ..... 105/311.1
6,352,036 B1 * 3/2002 Early ..... 105/377.06

* cited by examiner

*Primary Examiner*—S. Joseph Morano
*Assistant Examiner*—Robert J. McCarry, Jr.
(74) *Attorney, Agent, or Firm*—Paul M. Denk

(57) ABSTRACT

A remotely operated manhole cover for a tanker or trailer is provided. The manhole cover includes a hollow neck which is welded in place in the shell of the tanker or trailer. The neck defines an opening which allows access to the interior of the tanker or trailer for filling or cleaning of the tanker. A lid is pivotable about an axis between a closed position in which the manhole cover is closed, and an open position in which the lid is clear of the neck opening to allow access to the interior of the tanker. The lid is provided with an inflatable seal and locking flanges which extend from a rim of the lid. Pivotal locking members are provided on the neck and are movable between a locked position in which locking member engages the lid locking flange and an unlocked position in which the locking members are disengaged from the lid locking flange. Separate actuators are provide for the cover and the locking members. A controller is provided to energize the cover and locking member actuators and to inflate and deflate the seal. The controller activates the locking member and lid actuators and inflates or deflates the seal in sequence to unlock and open the lid or to close and lock the lid. The controller includes a manually operable switch assembly which activates the manhole cover to open and close the lid. The switch assembly is located remote from the manhole cover, and preferably near the bottom of the tanker.

15 Claims, 6 Drawing Sheets

REMOTELY OPERATED MANHOLE COVER FOR A TANKER

CROSS-REFERENCE TO RELATED APPLICATIONS

This application claims priority to Provisional Application Ser. No. 60/260,406 entitled "Remotely Operated Manhole Cover For A Tanker" and filed, Jan. 9, 2001.

STATEMENT REGARDING FEDERALLY SPONSORED RESEARCH OR DEVELOPMENT

Not Applicable.

BACKGROUND OF THE INVENTION

This invention relates to manhole covers for tanker cars, and in particular, to an automatic manhole cover.

Manhole covers are known for providing an inlet into a structure, such as a trailer tanks which hold particulate matter (i.e., grain, plastic pellets, flour, cement, sugar, etc.) as well as liquids.

The manhole covers typically provided on rail road tankers and truck trailers are manually operated covers. They include a series of cam operated levers which surround the manhole cover and are operable to lock and unlock the cover. To open and close prior manually operated manhole covers, someone must climb onto the tanker using a ladder at the back of the tanker. Then, he must walk along a catwalk which extends the length of the tanker until he reaches the manhole cover. To reach the manhole cover, and to provide enough leverage to operate the locks, the worker must step on the tanker shell itself. Working on top of a tanker can be precarious and exposes the worker to a risk of falling. The risk of falling increased if the tanker is wet or icy.

Further, the manual locks which hold the tank cover closed can be difficult to open. Again, the difficulty in opening the tank cover can be increased if the locks are, for example, frozen. This difficulty in operating the manual locks can increase the risk of falling.

Thus, it is desirable to not only make manhole covers easier to open and close, but to enable workers to remotely open and close manhole covers (i.e., from the ground).

BRIEF SUMMARY OF THE INVENTION

A remotely operated manhole cover for a tanker or trailer is provided. The manhole cover includes a hollow neck which is welded in place in the shell of the tanker or trailer. The neck defines an opening which allows access to the interior of the tanker or trailer for filling or cleaning of the tanker. A lid is pivotable about an axis between a closed position in which it closes the neck opening, and an open position in which the lid is clear of the neck opening to allow access to the interior of the tanker.

The lid includes a pair of locking flanges which extend from a rim of the lid. The locking flanges comprise a pair of spaced apart arms having a detent or groove formed in an upper surface of the arms. The lid also includes an inflatable seal in an underside of the lid. The seal is positioned to be in contact with the upper edge of the neck when the lid is closed to form a fluid tight seal with the neck.

The neck includes a pair of locking members which are positioned to engage the locking flanges of the lid. The locking members preferably comprise a pair of T-shaped members having a shaft and a cross-bar. The locking members are pivotally mounted to the neck and are movable between a locked position in which the cross-bars are received in the lid locking flange grooves and an unlocked position in which the locking members are disengaged from the lid locking flange.

Separate actuators are provided for the cover and the locking members. A cover actuator is operably connected to the cover to move the cover between its open and closed positions. Similarly, locking actuators are operably connected to the locking members to move the locking members between their locked and unlocked positions.

A controller is provided to energize the cover and locking member actuators and to inflate and deflate the seal. The controller activates the locking member, lid, and seal in sequence to unlock and open the lid or close and lock the lid. Thus, when the lid is to be opened, the controller first deflates the seal, then activates the locking member actuator to move the locking member from the locked to unlocked position, and finally opens the lid. Conversely, to close and lock the lid, the controller first energizes the lid actuator to close the lid, then energizes the locking member actuator to move the locking member to the locked position, and finally inflates the seal. When the seal is inflated, the lid is raised slightly to positively seat the neck locking member cross-bar in the lid locking flange grooves.

The controller includes a manually operated switch assembly which is switchable between a first position in which the manhole cover is moved from its closed and locked position to an unlocked and open position and a second position in which the manhole cover is moved from the open and unlocked position to its closed and locked position. Preferably, the switch assembly is located remotely from the manhole cover itself—such as near the bottom of the tanker where it can be reached by someone standing on the ground. Thus, no one need climb on to the tanker to open and close the manhole covers. The controller also includes a pair of lights. One light is energized when the lid is moved to the open position and the second light is energized when the lid is closed and the locking members are moved to their locked position.

BRIEF DESCRIPTION OF THE SEVERAL VIEWS OF THE DRAWINGS

Corresponding reference numerals will be used throughout the several figures of the drawings.

DETAILED DESCRIPTION OF THE INVENTION

The following detailed description illustrates the invention by way of example and not by way of limitation. This description will clearly enable one skilled in the art to make and use the invention, and describes what I presently believe is the best mode of carrying out the invention. Although the invention is described for use in conjunction with a tanker (such as a trailer tanker), the invention has applicability to any storage tank, whether that storage tank be part of a trailer tanker, a railroad tanker, a ship tanker, or an above ground or underground storage tank.

A tanker T includes a shell 3 which defines a chamber into which transportable material (i.e. particulates, liquids, or gases) are loaded for transportation. The tanker T includes at least one manhole assembly 5 of the present invention at its top which can be opened to allow material to be transported to be loaded into the tanker or to clean the tanker. The tanker T also includes hoppers outlets H at its bottom to allow the material to be unloaded from the tanker. The hoppers H do not form a part of the invention, and can be any desired type of hopper outlet. Although the tanker T is shown to be a trailer tanker, the manhole cover 5 of the present invention could also be used in conjunction with a railroad tanker, a tanker ship, storage tanks, or other types of tanks which are used to hold and store or transport material.

Figure 2:
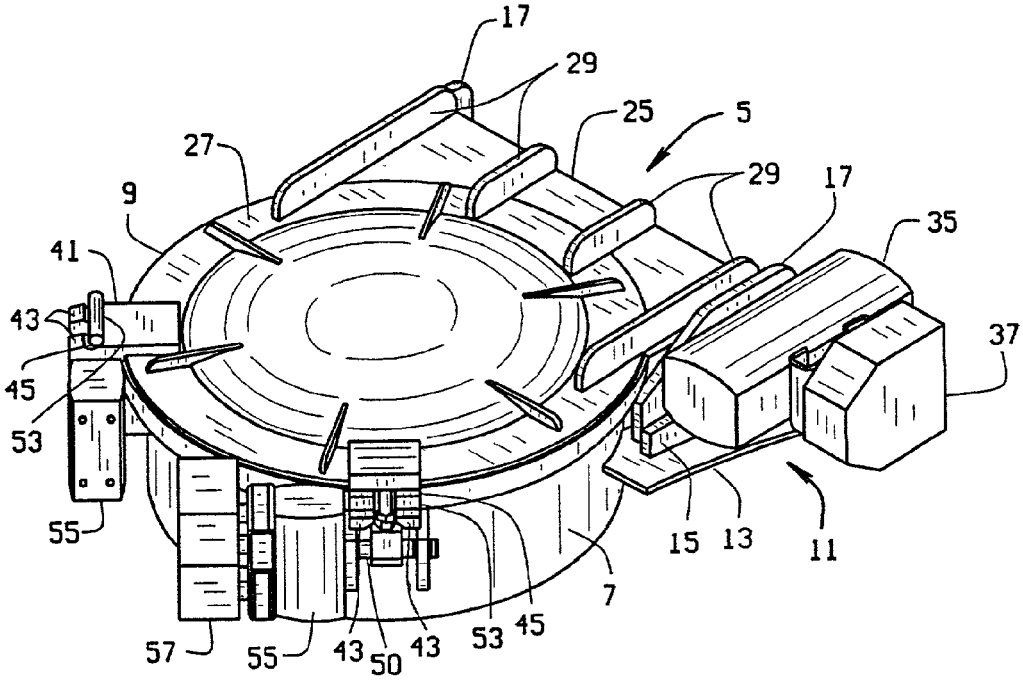
FIG. 2 is a perspective view of the manhole cover when closed.
Figure 3:
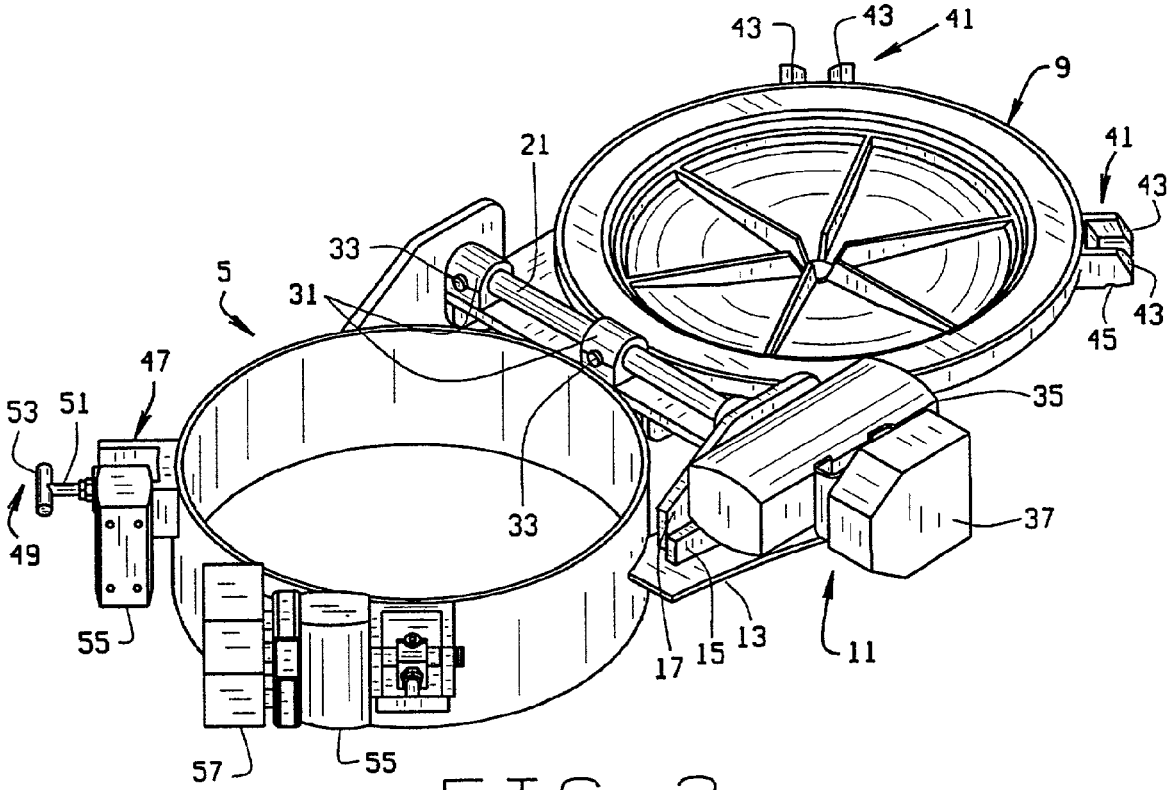
FIG. 3 is a perspective view of the manhole cover when opened.
Figure 4:
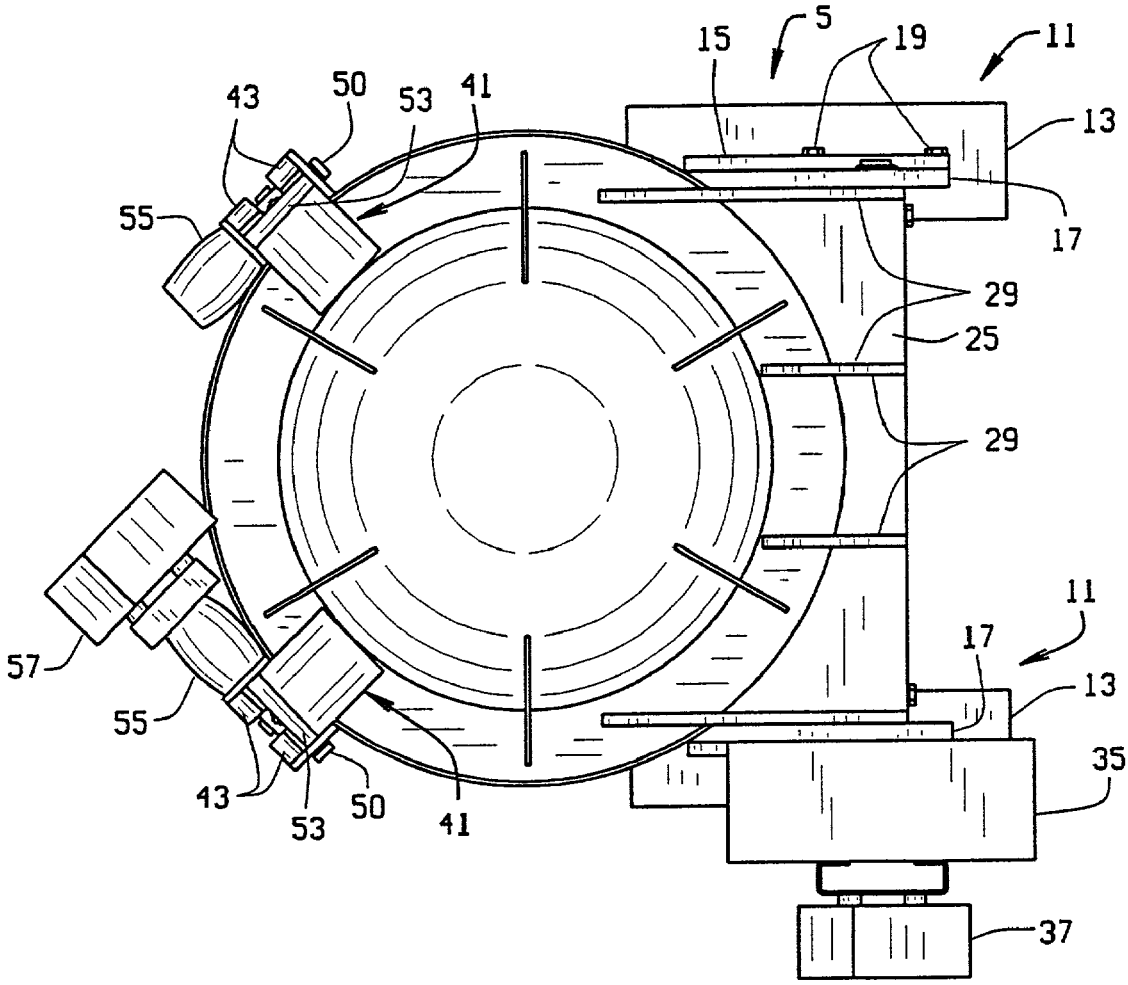
FIG. 4 is a top plan view of the manhole cover.
Figure 7:
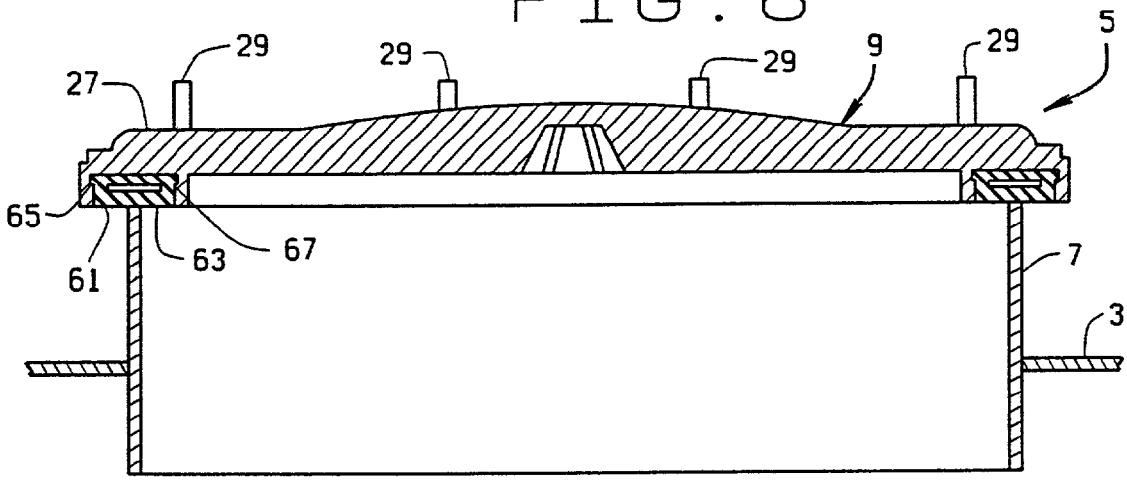
FIG. 7 is a cross-sectional view of the manhole cover taken along line 7—7 of FIG. 5 but with the actuating members removed for clarity, showing an inflatable seal in a deflated state.

The manhole cover assembly includes a neck or weld ring 7, which, as best seen in FIG. 7, is received in an opening in the tanker shell 3. The weld ring 7 is in the form of a cylinder which extends through the tanker shell 3 and which is welded in place to the tanker shell to define an opening into the tanker chamber. A cover 9 is hingedly mounted to the manhole cover assembly 5 to be selectively movable between a closed position (as shown in FIG. 2) in which it covers the weld ring 7 to prevent access into the tanker, and an open position (as shown in FIG. 3) in which the cover is clear of the weld ring, the weld ring is opened, and materials can be loaded into the tanker, or workers can enter the tanker to, for example, clean the tanker.

Figure 5:
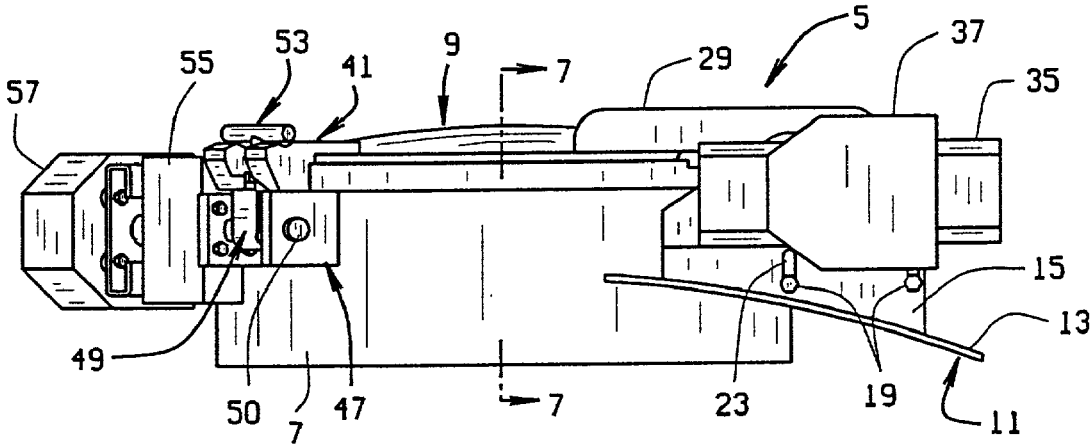
FIG. 5 is a side elevational view of the manhole cover.

A pair of brackets 11 extend rearwardly from the weld ring 7. The brackets 11 each include a base plate 13 which rests on the tanker shell 3 and an arm 15 extending up from the plate 13. A second arm 17 is mounted to the bracket arm 15 by bolts 19. A shaft 21 extends between the arms 17 and is mounted in the arms 17 to be rotatable. The arm 15 includes slots 23 (FIG. 5) through which the bolts 19 extend to allow for slight adjustment of the vertical position of the shaft 21 during assembly of the manhole cover assembly 5. Thus, the vertical position of the shaft 21 can be adjusted relative to the weld ring 5, to ensure that the cover 9 will properly close the neck 7.

Figure 6:
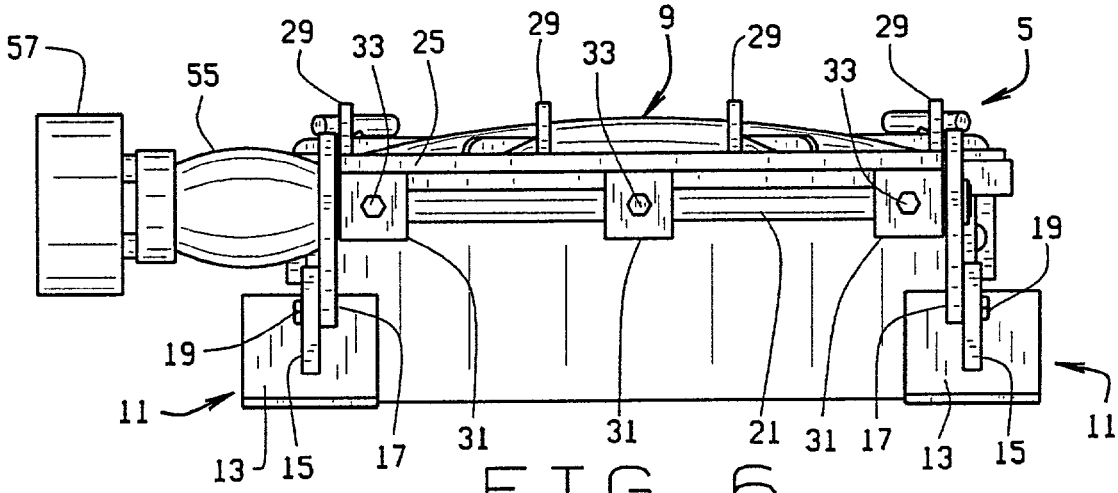
FIG. 6 is a rear view of the manhole cover.

The cover 9 includes a mounting flange 25 which extends rearwardly from the rim 27 of the cover 9. A plurality of ribs 29 extend over an upper or outer surface of the cover rim 27 and flange 25. As seen in FIGS. 3 and 6, the mounting flange 25 includes journals 31 through which the shaft 21 extends. The journals are fixed to the shaft 21 by bolts 33 which extend radially through the journals 31 and through the shaft 21. Thus the cover 9 and shaft 21 will rotate together, and the shaft 21 defines an axis of rotation for the cover 9.

A cover actuator 35 is mounted to the bracket 11 above the arm 15, adjacent the outer surface of the arm 17 to drive the shaft 21. As will be described below, activation of the actuator 35 will cause the actuator to rotate the shaft 21 and hence move the cover 9 between the open and closed positions. A limit switch 37 is mounted to, and operatively connected to, the actuator 35. The actuator 35 is preferably a pneumatic piston. The piston rod is connected to the shaft 21 by a link (not shown). Hence, extension and retraction of the piston rod will rotate the shaft 21. Alternatively, the piston could be mounted to the tanker shell 3 with its rod operatively connected to the cover rim 27, such that, upon extension and retraction of the piston rod, the cover 9 is moved between its open and closed positions.

To lock the cover 9 in its closed position, the cover 9 includes a pair of locking flanges 41 which extend out from the cover rim 27. Each locking flange 41 includes a pair of spaced apart arms 43 having a groove or detent 45 formed in the upper surface of the arms 43. The grooves 45 are spaced radially outwardly of the edge of the cover rim 27. A lock bracket 47 is mounted to the weld ring 3 to be below the locking flanges 41. The lock bracket 47 includes a pivotable T-member 49 having a stem 51 and a cross-bar 53. The T-member 49 is fixed to a shaft 50 which is rotatably mounted in the lock bracket 47. The T-member is thus movable between a locked position in which the cross-bar 53 is received in the groove 45 of the cover locking flange 41 and an unlocked position in which the T-member is disengaged from the cover locking flange 41. As can be appreciated, when the T-member engages the locking flange 41, pivotal movement of the cover will be prevented, and the cover 9 will be locked in a closed position. Each T-member 49 is moved between its locked and unlocked positions by its own actuator 55. A limit switch 57 is associated with only one of the actuators 55. However, the limit switch 57 is operably connected to both actuators 55. The actuators 55 are preferably pneumatic pistons. The piston rods are connected to the shafts 50 by a link. Hence, extension and retraction of the piston rod will rotate the shafts 50, causing the T-members 49 to pivot about the shafts 50.

Figure 8:
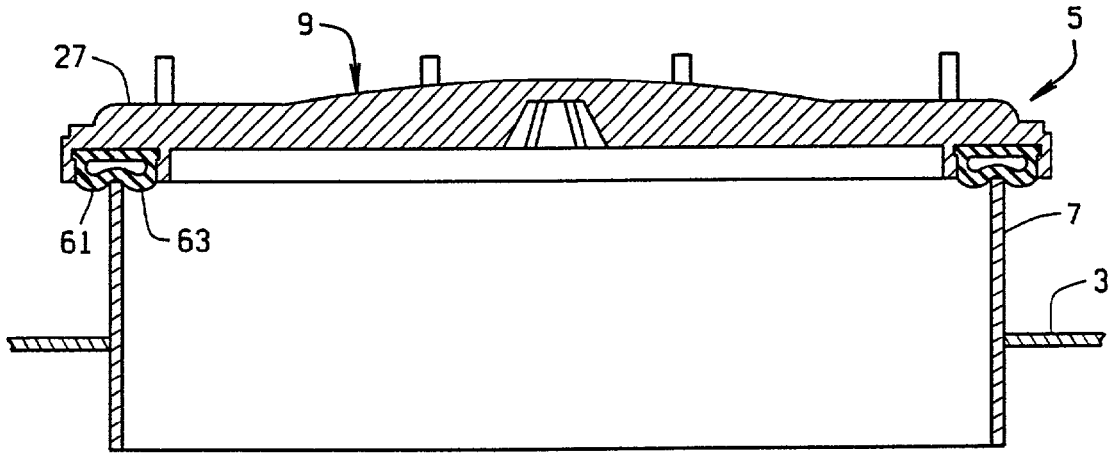
FIG. 8 is a view similar to FIG. 7, but showing the inflatable seal in an inflated state.

When the cover 9 is in its closed position, it is desirable to form a fluid and air tight seal between the cover 9 and the weld ring 3. To accomplish this, the cover 9 includes a circumferential channel 61 (FIGS. 7–8) in the underside of the cover rim 27. An inflatable annular seal 63 is received in the groove 61. The seal 63 is a hollow tube that is preferably made from a flexible, durable material, such as a nitrile. The seal 63 includes small flanges 65 extending around an inner and outer circumference of the seal near the top of the seal, giving the seal an overall appearance of a widened, flattened T. These flanges are received in small side grooves 67 in the channel 61. The flanges 65 and side groves 67 form a friction fit which holds the seal 63 in the channel 61. The seal 63 is connected to an air supply over an air line, and can be inflated and deflated. When the seal is deflated, as seen in FIG. 7, the seal is generally rectangular in cross-section. However, when the lid 9 is locked and the seal is expanded, as seen in FIG. 8, the seal 63 forms slight bumps on opposite sides of the weld ring 7. When the seal is inflated, an air and fluid tight seal is formed between the cover 9 and the weld ring 7. Additionally, as will be explained below, when the seal is inflated, the cover 9 is lifted slightly.

A junction box 71 (FIG. 1) is positioned adjacent the manhole assembly 5 and includes wiring to sequentially control the locking actuators 55, the cover actuator 35 and their associated limit switches, and the inflatable seal 63 to open and close the cover 9 and to lock and unlock the cover 9. The junction box 71 is connected to a control panel 73 which is at the base of the tanker T. A conduit 75 carries pneumatic and electrical lines between the control box and the junction box. The control panel 73 also includes connectors to connect the control box to a source of electricity 76 and a source of air, so that the cover can be operated.

Figure 1:
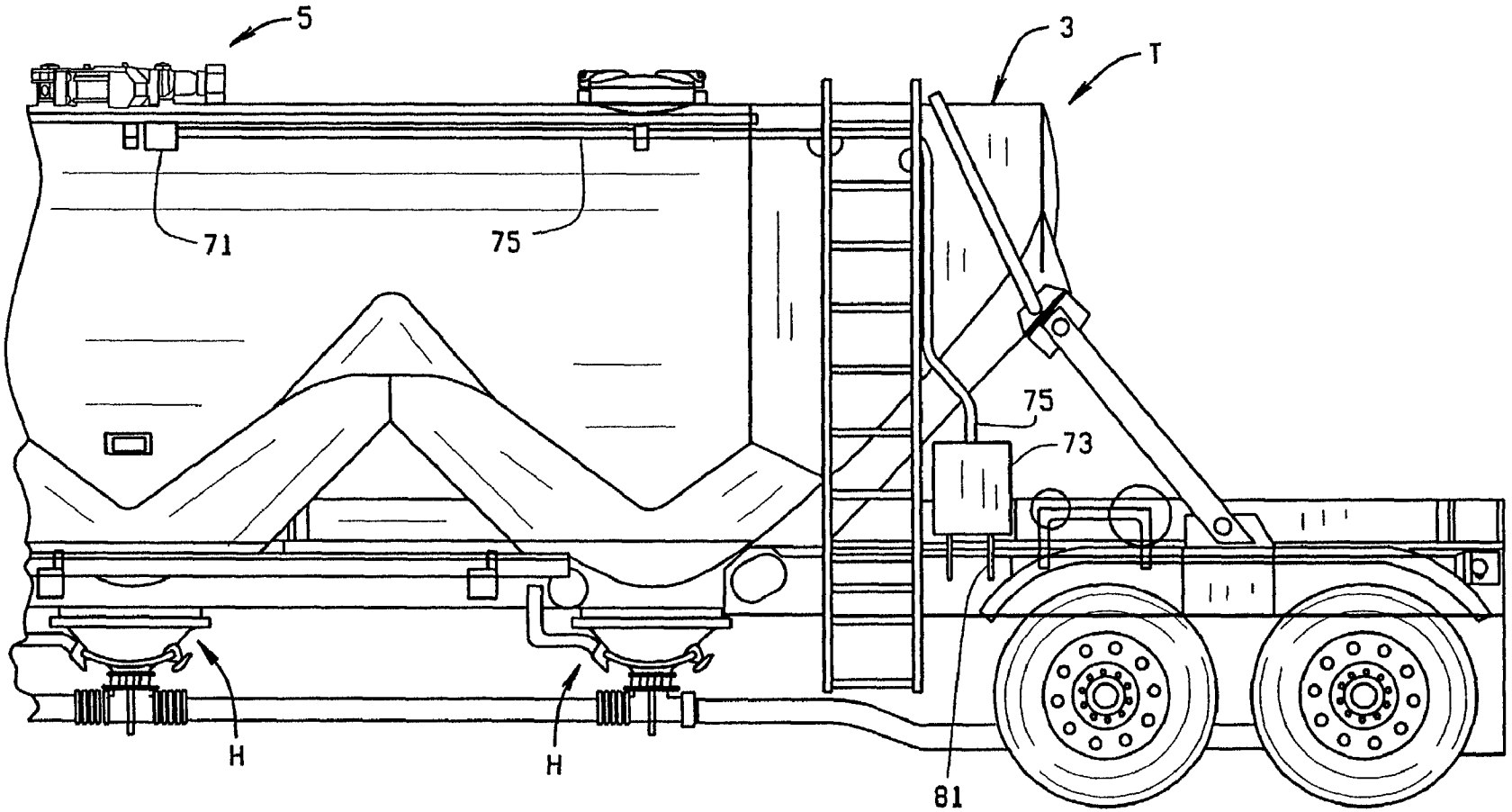
FIG. 1 is a fragmentary view of a tanker having a remotely operated manhole cover of the present invention.
Figure 9:
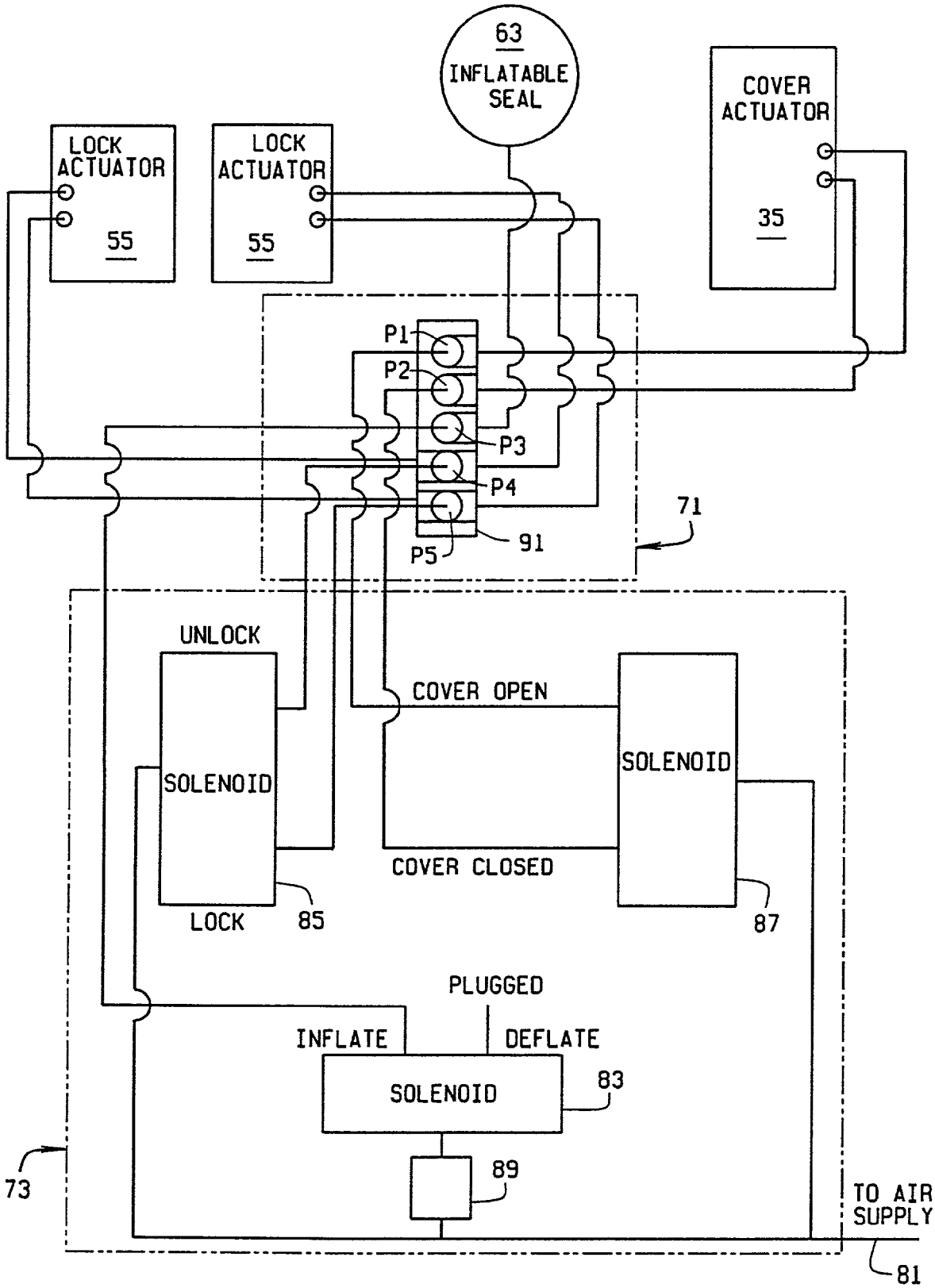
FIG. 9 is a schematic of the pneumatic system used to open and close the manhole cover as well as inflate and deflate the seal.

The pneumatic schematic is shown in FIG. 9. The control box 73 is connected to a supply of air over an air supply line 81. The supply air is directed to three valves: a valve 83 which controls the inflatable seal, a valve 85 which controls the cover locks, and a valve 87 which controls the cover 9. The valves 83, 85, and 87 are preferably spool valves which are movable between open and closed positions. Each spool valve has two associated activation solenoids. One solenoid moves the spool valve to its open position and the other solenoid moves the valve to its closed position. A pressure regulator 89 is placed in the line which leads from the supply line to the valve 83 which controls the seal. The outputs of the cover and lock valves 85 and 87 are connected to ports P1, P2 and P4 and P5 of a manifold 91, respectively. The one output of the seal valve 83 is connected to the port P3 of the manifold 91 and another output of the valve 83 is plugged. The manifold 91 is located in the junction box 71 in proximity to the weld ring and cover at the top of the tanker shell, and the valves 83, 85, and 87 are contained in the control box 73 at the base of the tanker. Thus, the five air tubes which connect the outputs of the valves 83, 85, and 87 to the manifold 91 are carried to the manifold 91 via the conduit 75 (FIG. 1).

The manifold ports P1 and P2 are connected to the ports of the cover actuator 35; the manifold port P3 is connected to the seal 63; and the ports P4 and P5 are connected to the two lock actuators 55. The lock and cover actuators 35 and 55 are all two-port actuators, so that the respective piston rods are positively extended and retracted by pneumatic pressure. Thus, one of the ports of the valves 85 and 87 are connected to the ports of the actuators 35 and 55 which cause the cover to open and the T-members to pivot open. Conversely, the other ports of the valves 85 and 87 are connected to the ports of the actuators 35 and 55 which cause the cover 9 to close and the T-members to pivot to their locked position.

Figure 10:
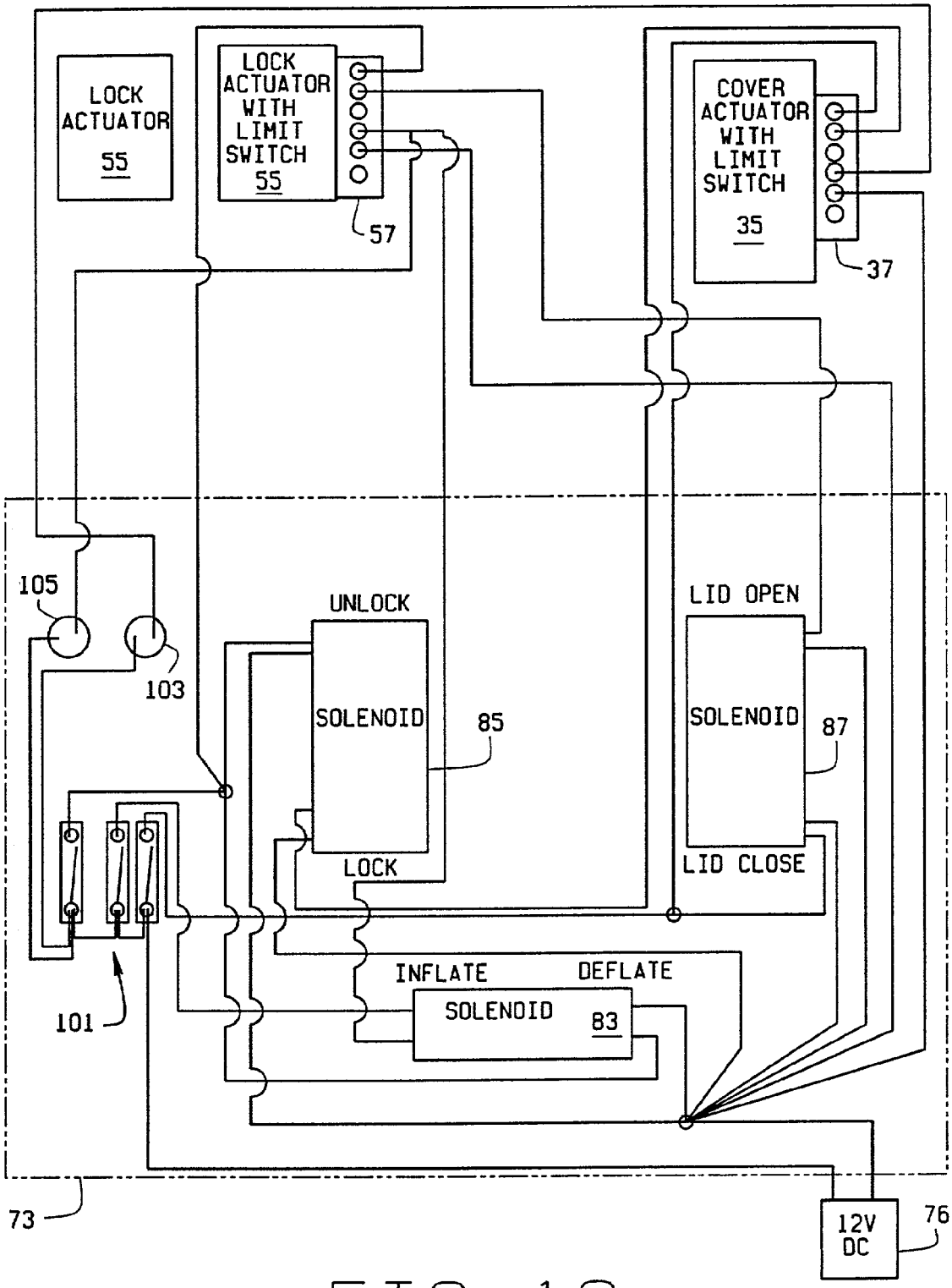
FIG. 10 is an electrical schematic of the control for the manhole cover.

The electrical schematic is shown in FIG. 10. The control box 73, as noted above, contains the valves 83, 85, and 87. It also contains a switch 101 which is a single throw-triple pole switch. The switch is movable between a first position to cause the cover to open and a second position to cause the cover to close and lock. The control box 73 also includes a pair of indicator lights 103 and 105. The switch 101, valves 83, 85, and 87, and the actuators are wired together as seen in FIG. 10 so that the elements operate in sequence. The limit switches 37 and 57 each transmit a signal to the controller indicative of the amount of rotation of the respective shafts (i.e., the lid shaft 21 and the lock shafts 50). Thus, the controller knows when the lid and lock arms are in their open (or closed) positions, and hence when it is time to signal the next event in the unlocking and opening of the lid or the closing and locking of the lid. Thus, with the cover closed and locked, when the switch 101 is moved to the "open" position, the valve 83 is activated to deflate the seal 63. As the seal is deflated, the cover 9 lowers slightly to allow the T-member 49 to disengage the locking flange 41. Once the seal 63 is deflated, a signal is sent to the actuators for the valve 85 to activate the actuators 55 to move the T-members 49 from their locked to unlocked positions. Then, a signal is sent to the actuators for the valve 87 to activate the actuator 35 to open the cover 9. Once the cover is opened, the "open" light 103 is turned on to indicate that the cover has been opened.

Conversely, when the cover 9 is-to be closed, the switch 101 is moved to the closed position. This sends a signal to the actuators for the valve 87 to activate the actuator 35 to close the cover 9. Once the cover 9 is closed, a signal is sent to the actuators for the valve 85 to activate the actuators 55 to move the T-members from their unlocked to locked positions, in which the cross-bars 51 are received in the locking flange grooves 43. Once the T-members are in their locking position, a signal is sent to the valve 83 to inflate the seal 63. As the seal 63 inflates, it raises the cover 9 so that the T-member cross-bars will be positively received in the locking flange grooves 43, to prevent the T-members from becoming disengaged from the locking flanges 41. When the cover is closed-and locked, the "close" light 105 is lit.

As noted, two actuators (i.e., solenoids) are associated with each of the valves 83, 85, and 87. Thus, for example, the valve 87 will remain in its open position after its open solenoid has been activated until the close solenoid is activated to move the valve 87 to the close position. Thus, should air or electricity ever be removed from the system for any reason, the valves will stay in the position they are in when air or electricity is lost.

As can be appreciated, the automatic manhole cover 5 can be operated from ground level. Thus, no one is required to climb on top of the tanker T to unlock and open, or close and lock, the covers the manholes. Additionally, the inflatable seal 63 provides an air tight and fluid tight seal between the cover 9 and the weld ring 7. Because the seal is inflatable, if a groove is worn in the seal, it will not affect the seal between the cover 9 and the welding ring 7.

As various changes can be made in the above constructions without departing from the scope of the invention, it is intended that all matter contained in the above description or shown in the accompanying drawings shall be interpreted as illustrative and not in a limiting sense. For example, although the actuators 35 and 55 are disclosed to be pneumatic actuators, the actuators could also be electro-magnetic actuators, hydraulic actuators, gear driven actuators, cam driven actuators, or any other type of actuator which can be operated to pivot the lid 9 and T-members 49. Although one switch is shown (and preferred) to activate the system, two separate switches could be provided, so that there would be one switch to activate the cover actuator and another switch to activate the lock actuators. The switch could be a push-button switch, rather than a flip switch. The T-members and the locking flanges can be reversed, such that the locking flanges 41 are on the weld ring 7 and the T-members 49 are on the cover 9. The T-members 49 can be replaced with any other pivotal member which can engage a locking flange to maintain the cover in its closed position. Although the tanker is described to include a weld ring on which the cover is pivotally mounted, the weld ring can be eliminated, and the cover can pivot relative to the tanker shell itself, and can seal about the opening in the tank shell. These examples are merely illustrative.

The invention claimed is:

1. A remotely operated manhole cover for a tanker, the tanker having a shell defining a chamber which receives transportable materials; the manhole cover comprising:

a hollow neck having a side wall defining an opening and at least one locking member operatively mounted to said side wall to be movable between a locked position and an unlocked position;

a cover pivotable about an axis of rotation between a closed position in which said cover closes said hollow neck and an opened position in which said cover is substantially clear of said neck opening; said cover including at least one radially extending locking flange positioned on said cover to be aligned with said neck locking member when said cover is in its closed position;

a cover actuator operatively connected to said cover to move said cover between its opened and closed positions;

a lock actuator operatively connected to said at least one locking member to move said locking member between its locked position in which said locking member engages said cover locking flange and its unlocked position in which said locking member is clear of said cover locking flange;

a cover activator which, when energized, causes said cover actuator to move said cover between its opened and closed positions;

a lock activator which, when energized, causes said lock actuator to move said at least one locking member between its locked and unlocked positions; and, a controller in communication with said cover activator and said lock activator and receiving communication from said cover actuator and said lock actuator denoting positions of the same; said controller energizing said cover activator separately from said lock activator and in sequence to move said cover between its opened and closed positions and to move said locking member between its locked and unlocked positions, and said controller having one or more lights indicating whether said cover is in an opened or closed position.

2. The remotely operated manhole cover of claim 1 wherein said controller includes a manually operable switch assembly in communication with said cover activator and said lock activator; said switch selectively movable between a distinct cover open position in which said switch assembly energizes said cover activator and said lock activator to unlock and open said cover and a distinct cover closed position in which said switch assembly energizes said cover activator and said lock activator to close and lock said cover.

3. The remotely operated manhole cover of claim 2 wherein said switch assembly comprises a single switch.

4. The remotely operated manhole cover of claim 1 includes a hollow, generally tubular seal in an underside of said lid; said seal engaging an upper surface of said neck when said cover is in its closed position to form a fluid tight seal between said cover and said neck.

5. The remotely operated manhole cover of claim 4 wherein said seal includes an inflatable/deflatable seal; said manhole cover including an air supply line which is operably connectable to a source of air and is in communication with said inflatable seal; said seal inflating and deflating in response to signals from said controller between an inflated state and a deflated state.

6. The remotely operated manhole cover of claim 5 wherein said controller is operable to deflate said seal to unlock and open said manhole cover and is operable to inflate said seal to lock said manhole cover.

7. A remotely operated manhole cover for a storage tank, the tank having a shell defining a chamber which receives flowable materials and an opening in said shell which is closed by said manhole cover; the manhole cover comprising:

a cover pivotable about an axis of rotation between a closed position n which said cover closes said tank opening and an open position in which said cover is substantially clear of said tank opening;

a locking assembly having a first portion radially mounted to said cover and a second portion radially mounted to said tank shell; said locking assembly being movable between a locked position in which said first and second portions are engaged to hold said cover in its closed position and an unlocked position in which said first and second portions are disengaged to allow said cover to be moved to its opened position;

a cover actuator operatively connected to said cover to move said cover between its opened and closed positions;

a lock actuator operatively connected to said locking assembly to move said locking assembly between its locked and unlocked positions; and, a controller in communication with said cover actuator and said lock actuator and receiving communication from said cover actuator and said lock actuator denoting positions of the same; and said controller activating a cover activator separately from said lock activator and in sequence to unlock and open said cover and to close and lock said cover.

8. The remotely operated manhole cover of claim 7 including a hollow, generally tubular seal in an underside of said cover; said seal forming a fluid tight seal between said cover and said tank opening.

9. The remotely operated manhole cover of claim 8 wherein said seal is an inflatable/deflatable seal; said manhole cover including an air supply line which is operably connectable to a source of air and is in communication with said inflatable seal; said seal inflating and deflating in response to signals from said controller between an inflated state and a deflated state.

10. The remotely operated manhole cover of claim 9 wherein said controller is operable to deflate said seal to unlock and open said manhole cover and is operable to inflate said seal to lock said manhole cover.

11. The remotely operated manhole cover of claim 7 wherein said controller includes a switch located remotely from said cover; said switch being movable between a distinct first position to close and lock said cover and a distinct second position to unlock and open said cover.

12. A remotely operated manhole cover for a tanker, the tanker having a shell defining a chamber which receives transportable materials, comprising:

a hollow neck having a side wall defining an opening and at least two locking members symmetrically disposed and operatively mounted to said side wall to be movable between a locking position and an unlocked position;

a cover pivotable about an axis of rotation between a closed position closing said hollow neck and an opened position clearing said neck opening; said cover including at least two radially extending locking flanges positioned on said cover to be aligned with said neck locking members when said cover is in its closed position, wherein said locking members and said locking flanges in cooperation with said cover secure said cover at least three points;

a cover actuator operatively connected to said cover to move said cover between its opened and closed positions;

a lock actuator operatively connected to said at least two locking members to move said locking member between its locking position in which said locking member engages said cover locking flange and its unlocked position in which said locking member is clear of said cover locking flange;

a cover activator which, when energized, causes said cover actuator to move said cover between its opened and closed positions;

a lock activator which, when energized, causes said lock actuator to move said locking member between its locked and unlocked positions; and, a controller in communication with said cover activator and said lock activator and receiving communication from said cover actuator and said lock actuator denoting positions of the same; said controller energizing said cover activator separately from said lock activator and in sequence to move said cover between its opened and closed positions and to move said locking member between its locked and unlocked positions, and said controller having one or more lights indicating whether said cover is in an opened or the closed position.

13. The remotely operated manhole cover of claim 12 wherein said locking members and said locking flanges are mutually and symmetrically disposed on both sides of the longitudinal axis of said cover; said longitudinal axis extending perpendicular to the axis of rotation of said cover and through the center of said cover.

14. The remotely operated manhole cover of claim 13 wherein said locking members and said locking flanges are approximately forty five degrees in rotation away from said longitudinal axis.

15. The remotely operated manhole cover of claim 13 further comprising:

a pair of arms symmetrically joined to said shell and then to a mounting flange, said mounting flange joined to and coplanar with said cover coaxial with the axis of rotation;

whereby each of said locking members and said locking flanges are located adjacent to an axis extending from each of said arms.

* * * * *